United States Patent [19]

Kubo et al.

[11] 4,309,192

[45] Jan. 5, 1982

[54] TREATMENT OF WATER-CONTAINING COAL

[75] Inventors: Isao Kubo, Tokyo; Shigemi Nagayoshi, Hikari; Futao Sakata, Tokyo; Tetsuo Wada, Aoba; Shoichi Ói, Ogawa, all of Japan

[73] Assignees: Mitsui Mining Co. Ltd.; Mitsui Coke Co. Ltd., both of Tokyo, Japan

[21] Appl. No.: 163,905

[22] Filed: Jun. 27, 1980

[30] Foreign Application Priority Data

| | | | |
|---|---|---|---|
| Jul. 20, 1979 | [JP] | Japan | 54/91662 |
| Jul. 20, 1979 | [JP] | Japan | 54/91663 |
| Aug. 22, 1979 | [JP] | Japan | 54/105928 |

[51] Int. Cl.[3] ..... C10L 1/32

[52] U.S. Cl. ..... 44/51; 209/173; 209/182

[58] Field of Search ..... 44/1 A, 1 B, 1 G, 1 R, 44/23, 24, 51; 209/171, 173, 182

[56] References Cited

U.S. PATENT DOCUMENTS

| | | | |
|---|---|---|---|
| 2,162,200 | 6/1939 | Kiesskalt et al. | 44/1 A |
| 4,018,571 | 4/1977 | Cole et al. | 44/1 G |
| 4,057,399 | 11/1977 | Cole et al. | 44/1 B |
| 4,156,596 | 5/1979 | Capes et al. | 44/23 |

*Primary Examiner*—Carl F. Dees

[57] ABSTRACT

Disclosed is a process for the treatment of water-containing coal which comprises mixing the water-containing coal with a hydrocarbon oil having a specific gravity higher than that of water at temperatures in the range of 100° to 350° C.; heating the resulting mixture at a temperature in the range of 100° to 350° C. and a pressure not lower than the saturated vapor pressure of water at that temperature; and then allowing the heated mixture to settle at a temperature in the range of 100° to 350° C. and a pressure not lower than the saturated vapor pressure of water at that temperature, whereby an upper layer consisting of the water separated from the water-containing coal is formed on a lower layer consisting of the mixture of the dehydrated coal and the hydrocarbon oil.

13 Claims, 4 Drawing Figures

TREATMENT OF WATER-CONTAINING COAL

BACKGROUND OF THE INVENTION (1) Field of the Invention

This invention relates to the treatment of water-containing coal and, more particularly, to a process for the treatment of water-containing coal in which the water-containing coal is treated with a hydrocarbon oil to prepare the mixture consisting of the dehydrated coal and the hydrocarbon oil.

(2) Description of the Prior Art

Recently, the liquefaction of coal has come to attract much attention because it can offer a solution to oil shortage, and this subject is being studied more and more extensively. Typical methods for the liquefaction of coal includes the solvolysis process using a heavy oil obtained from petroleum and the hydrogenation process using a circulating solvent. The raw material used in the solvolysis process is a slurry of dehydrated coal in asphalt and that used in the hydrogenation process is a slurry of dehydrated coal in a circulating solvent.

Before being formed into a slurry, coal to be used in such coal liquefaction processes should desirably be freed of ash and moisture as completely as possible. In fact, some types of coals (i.e., bituminous coal and sub-bituminous coal) are subjected to a coal-preparation process for removing ash as completely as possible, because its removal after liquefaction is difficult. The use of water is effective in coal deashing process, and the separation efficiency becomes higher as the particle size of the coal is decreased. Accordingly, the current trend of the coal-preparation art is toward the treatment of finely-ground coal in a wet process. However, the use of water in coal deashing naturally causes the coal to be wetted with water, and the amount of water attached thereto increases as the particle size of the coal is decreased. Especially when the removal of ash is difficult, it is desirable to grind the coal to 1-mm size or finer prior to coal deashing process. In this case, the amount of water attached to the dressed coal can hardly be reduced to less than 20% by resorting to conventional mechanical means of dehydration. Moreover, when the coal processing plant is distant from the coal mine, economic advantages are obtained by crushing the coal to 4-mm size or finer and conveying it in the form of an aqueous slurry having a solids concentration of the order of 50%. In either case, the dehydration of such water-containing coal is a critical problem if it is to be used as a raw material for the liquefaction of coal.

On the other hand, so-called low-grade coals such as grass peat, peat, lignite, brown coal, some types of sub-bituminous coal, etc. are found in abundance all over the world. Not a few of them are low in ash content, capable of being mined at slight cost, and easy of liquefaction by the hydrogenation process. However, since these low-grade coals have strongly hydrophilic properties, they have a water content of at least 25% and, moreover, cannot be subjected to any coal-dressing process involving the use of water. Accordingly, the dehydration of these low-grade coals is disadvantageous from the viewpoints of technology, safety, and economics, and they are used exclusively for field power generation under the existing circumstances.

Thus, both high-grade and low-grade coals come to have a high water content and, therefore, require dehydration prior to their use in coal liquefaction processes. In carrying out this dehydration, it would be most desirable to employ a process which produces a mixture consisting of the dehydrated coal and a solvent for use in the liquefaction of coal and having an optimum coal concentration.

SUMMARY OF THE INVENTION

It is an object of the present invention to provide an improved process for the treatment of water-containing coal.

It is another object of the present invention to provide a process for the treatment of water-containing coal in which the dehydration of the water-containing coal and the preparation of a slurry of the dehydrated coal in a solvent are effected at the same time.

According to the present invention, there is provided a process for the treatment of water-containing coal which comprises (a) in a mixing zone, mixing the water-containing coal with a hydrocarbon oil having a specific gravity higher than that of water at temperatures in the range of 100° to 350° C.;

(b) heating the resulting mixture at a temperature in the range of 100° to 350° C. and a pressure not lower than the saturated vapor pressure of water at that temperature; and (c) introducing the heated mixture into a gravity separation zone maintained at a temperature in the range of 100° to 300° C. and a pressure not lower than the saturated vapor pressure of water at that temperature, whereby the water separated from the water-containing coal is withdrawn from an upper section of the gravity separation zone and the mixture consisting of the dehydrated coal and the hydrocarbon oil is withdrawn from a lower section of the gravity separation zone.

The term "coal" as used herein denotes various types of coal such as anthracite, bituminous coal, sub-bituminous coal, brown coal, etc.; various types of lignite such as grass peat, peat, etc.; and wood chips, papermaking plant sludge, cellulose, and other solid organic materials composed largely of carbon.

DETAILED DESCRIPTION OF THE INVENTION

Figure 1:
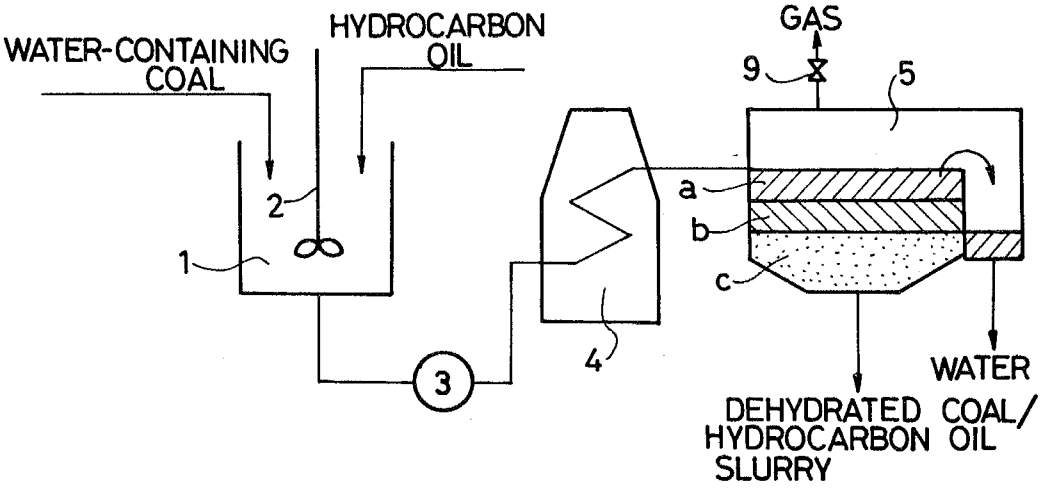
FIG. 1 is a flow sheet illustrating one embodiment of the present invention.

In carrying out the process of the present invention, no particular restriction is imposed on the water content of the coal to be treated.

The hydrocarbon oil used as the solvent is one having a specific gravity higher than that of water at temperatures in the range of 100° to 350° C. Where the hydrogenation process is employed as the succeeding coal liquefaction process, circulating solvents for use in the liquefaction of coal and/or hydrocarbon oils obtained from coal are used in typical cases. Where the solvolysis process is employed, hydrocarbon oils (e.g. asphalt) obtained from petroleum are used in typical cases. However hydrocarbon oils obtained from petroleum, hydrocarbon oils obtained from coal, circulating solvents for use in the liquefaction of coal, and mixtures thereof are all usable for the present purpose.

The ratio in which the water-containing coal is mixed with the solvent is chosen so that the ratio of the dehydrated coal to the solvent will be suited to the succeeding process (e.g. coal liquefaction process). However, depending on the types of coal and solvent used, the above-defined optimum ratio may give such high viscosity that the mixture cannot be handled as a fluid. In such a case, it is unavoidable to decrease the amount of coal used. The temperature at which the water-containing coal is mixed with the solvent may be chosen arbitrarily, provided that the viscosity of the mixture allows it to be handled as a fluid. However, if the temperature exceeds 100° C., the mixing must be carried out under pressure. This is because, under atmospheric pressure, the vaporization of water prevents the temperature of the mixture from rising to the desired level.

The resulting mixture of the water-containing coal and the solvent is heated at a temperature in the range of 100° to 350° C. and a pressure not lower than the saturated vapor pressure of water at that temperature, and then introduced into a gravity separation zone. This heating step reduces the viscosity of the solvent, so that the coal and the solvent come to settle easily due to their higher specific gravities than that of water and thus cause water to float thereon. If the temperature of the gravity separation zone is lower than 100° C., the separation rate is too low for practical purposes, as is known in connection with the dehydration of coal tar. In the case of anthracite, bituminous coal, some types of sub-bituminous coal, and other strongly oleophilic solid organic materials, the separation of water occurs under substantially the same temperature condition as used in the dehydration of coal tar, or at a temperature in the range of 120° to 150° C. or a little higher, though its success depends on the type of solvent used. In the case of strongly hydrophilic solid organic materials such as brown coal, peat, grass peat, etc., the separation of water is difficult because they are apt to be dispersed in the solvent to form an emulsion. However, these hydrophilic solid organic materials can be rendered oleophilic by heating them at a temperature of 100° C. or above and preferably 200° C. or above. The reason for this is believed to be that, as has been reported by investigators at the University of Melbourne, Australia, the oxygen-containing groups present in these organic materials are decomposed at that temperature. Accordingly, if they are heated at such a temperature as to render them sufficiently oleophilic and thereby prevent them from forming an emulsion, the separation of water occurs in the gravity separation zone. During this heating step, a pressure not lower than the saturated vapor pressure of water should be applied in order to prevent the vaporization of water and the heat loss caused thereby. However, it will be obvious to those skilled in the art that temperatures of 374.15° C. (the critical temperature of water) or above cannot be used because liquid water exists no longer at those temperatures.

The residence time in the gravity separation zone may vary according to the affinity for oils of the coal present therein and the viscosity of the solvent present therein. Specifically, if the solvent has low viscosity and the coal inherently has strongly oleophilic properties, the residence time in the gravity separation zone may be of the order of 30 minutes at a temperature of 180° C. and a pressure of 10 kg/cm$^2$ G. This residence time can be shortened by increasing the temperature. If the coal has strongly hydrophilic properties, it may be rendered oleophilic by heating it at a suitable temperature, and then introduced into the gravity separation zone. By way of example, when strongly hydrophilic coal is heated at a temperature of 250° C. and the gravity separation zone is also maintained at a temperature of 250° C., the residence time in the gravity separation zone should be of the order of 40 minutes. The temperature of the gravity separation zone need not necessarily be equal to the heating temperature. However, since the vaporization of water in the gravity separation zone must also be prevented, a pressure higher than the saturated vapor pressure of water at the temperature of the gravity separation zone should be applied.

Thus, the temperature and pressure of the gravity separation zone, the residence time in the gravity separation zone, and other parameters should be determined by taking into account all the necessary considerations including the types of coal and solvent used, the economic factors of the pressure vessel, the type of the succeeding treatment, and the like.

The water withdrawn from an upper section of the gravity separation zone has a temperature equal to that of the gravity separation zone and, therefore, can be directly utilized in a step of preheating the mixture. Moreover, this water contains a considerable amount of organic matter and has a chemical oxygen demand (COD) of 10,000 ppm or higher. This COD level permits a wet oxidation process to be suitably applied to the treatment of the water. Since the heat content of the water is increased in consequence, a higher thermal efficiency can be achieved by utilizing it for the purpose of preheating the mixture.

The dehydrated mixture consisting of the dehydrated coal and the hydrocarbon oil is withdrawn from a lower section of the gravity separation zone. If the degree of dehydration is sufficient, the dehydrated mixture remaining at the temperature and pressure of the gravity separation zone can be directly fed to a coal liquefaction process. If the degree of dehydration is insufficient, the dehydrated mixture may be subjected to another dehydration step. That is, when the dehydrated mixture having a temperature of 100° C. or above is withdrawn from the gravity dehydration zone and then exposed to a reduced pressure, an additional amount of water is removed by evaporation. However, if the dehydrated mixture having a sufficient degree of dehydration and a relatively high temperature is exposed to an excessively reduced pressure, a large amount of the hydrocarbon oil may be evaporated. Accordingly, the temperature of the gravity separation zone and the degree of reduction in pressure should be taken into due consideration.

If the mixture formed of water-containing coal and a hydrocarbon oil has excessively high viscosity, the amount of water-containing coal used must be decreased. In such a case, the dehydrated mixture can have a coal concentration lower than that desired for the succeeding coal liquefaction process. In order to overcome this difficulty, the dehydrated mixture may desirably be introduced into a concentration zone, where the residual water and a part of the hydrocarbon oil are removed to increase the coal concentration of the dehydrated mixture to the desired level.

Several preferred embodiments of the present invention will hereinafter be described in connection with the accompanying drawings.

Referring to FIG. 1, a mixing tank 1 is charged with water-containing coal and a hydrocarbon oil in any desired proportion. These raw materials are mixed by means of an agitator 2. A certain type of hydrocarbon oil has excessively high viscosity at temperatures below 100° C. and, therefore, requires an additional step of preheating it to a temperature of 100° C. or above. In such a case, the mixing tank 1 must comprise a pressure vessel into which the water-containing coal is put through a rock hopper or the like and the preheated hydrocarbon oil is introduced under pressure. The mixture consisting of the water-containing coal and the hydrocarbon oil is withdrawn from mixing tank 1, pressurized to a predetermined pressure by means of a pump 3, heated in a heater 4, and then introduced into a gravity separation tank 5. In this gravity separation tank 5, the dehydrated coal and the hydrocarbon oil settle under the influence of gravity to form a slurry layer c, while the water separated from the water-containing coal floats thereon to form a water layer a. In addition, an intermediate layer b is formed between the water layer a and the slurry layer c. In order to minimize the thickness of the intermediate layer b and thereby prevent this layer from being withdrawn, the operating conditions (such as temperature, pressure, settling time, etc.) of gravity separation tank 5 should be properly controlled according to the types of water-containing coal and hydrocarbon oil used. The water separated from the water-containing coal is withdrawn by allowing it to overflow the top of gravity separation tank 5 or by resorting to other suitable means, and then fed to an additional preheating step or a wet oxidation process. On the other hand, the dehydrated slurry consisting of the dehydrated coal and the hydrocarbon oil is withdrawn from the bottom of gravity separation tank 5. If the degree of dehydration is sufficient, this slurry can be directly fed to a plant for further processing the dehydrated coal/hydrocarbon oil slurry. Where the generation of gas by decomposition of oxygen-containing groups and the like is noted in gravity separation tank 5, it is desirable to remove it with a vent 9.

Figure 2:
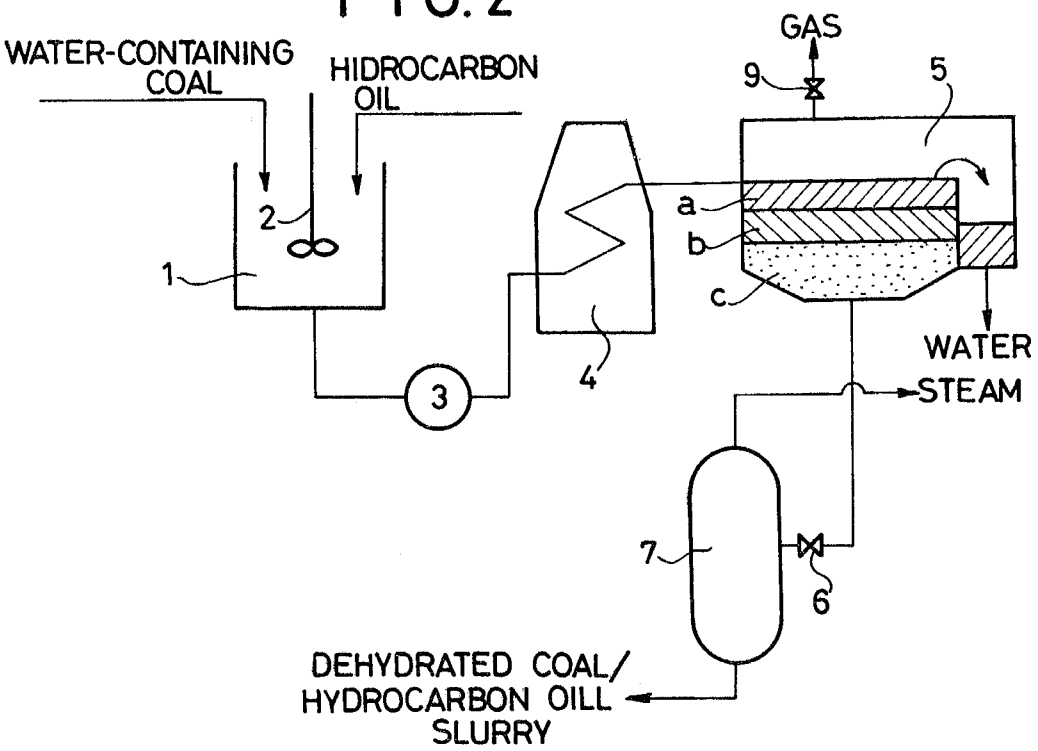
FIG. 2 is a flow sheet illustrating another embodiment of the present invention.

FIG. 2 is a flow sheet illustrating another embodiment of the present invention. This embodiment is applicable to the case in which the slurry prepared in accordance with the embodiment illustrated in FIG. 1 shows an insufficient degree of dehydration. Up to completion of the gravity separation step, water-containing coal is treated in the same manner as described in connection with FIG. 1. Thereafter, the dehydrated slurry consisting of the dehydrated coal and the hydrocarbon oil is withdrawn from the bottom of gravity separation tank 5 and then fed through a reducing valve 6 to a flash evaporator 7, where an additional amount of water is evaporated by utilization of the heat energy possessed by the slurry. After this second dehydration step, the resulting slurry is fed to a plant for further processing the dehydrated coal/hydrocarbon oil slurry.

Figure 3:
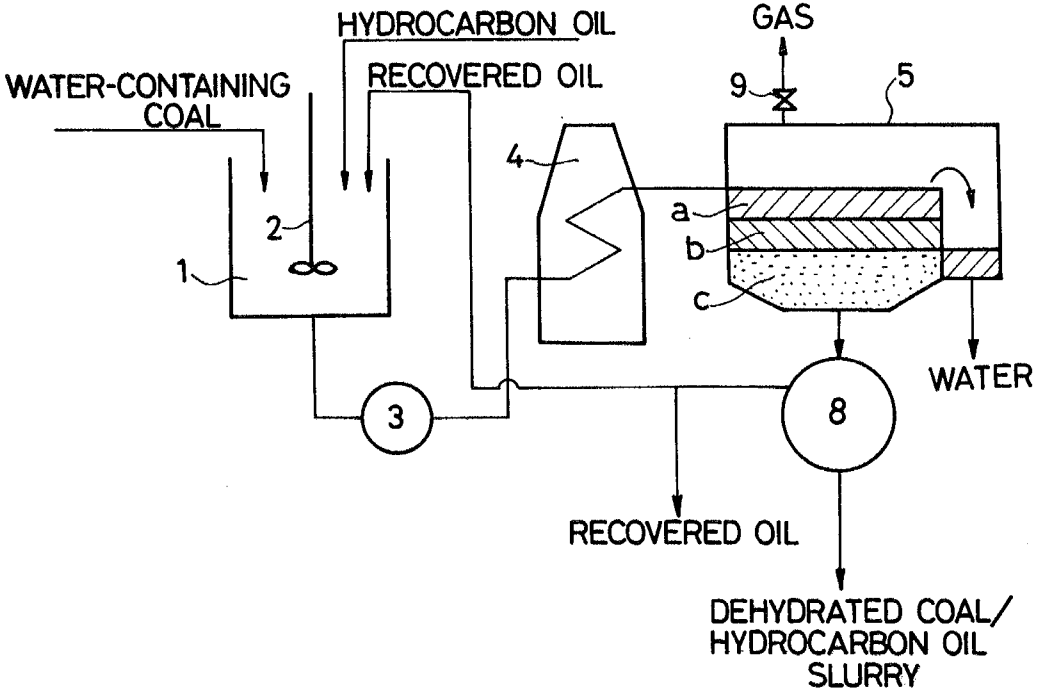
FIG. 3 is a flow sheet illustrating still another embodiment of the present invention.

FIG. 3 is a flow sheet illustrating still another embodiment of the present invention. This embodiment is applicable to the case in which the viscosity of the mixture formed in mixing tank 1 is too high and, therefore, the coal concentration of this mixture must be reduced to a suboptimum level. After the gravity separation step, the dehydrated slurry is introduced into a concentrator 8, where the residual water and a part of the hydrocarbon oil are removed to concentrate the slurry. Thereafter, the slurry now having an adequate coal concentration is fed to a coal processing plant such as coal liquefaction plant. The hydrocarbon oil (or recovered oil) removed in concentrator 8 may be utilized as a part of the hydrocarbon oil used in mixing tank 1 or for other desired purposes.

Figure 4:
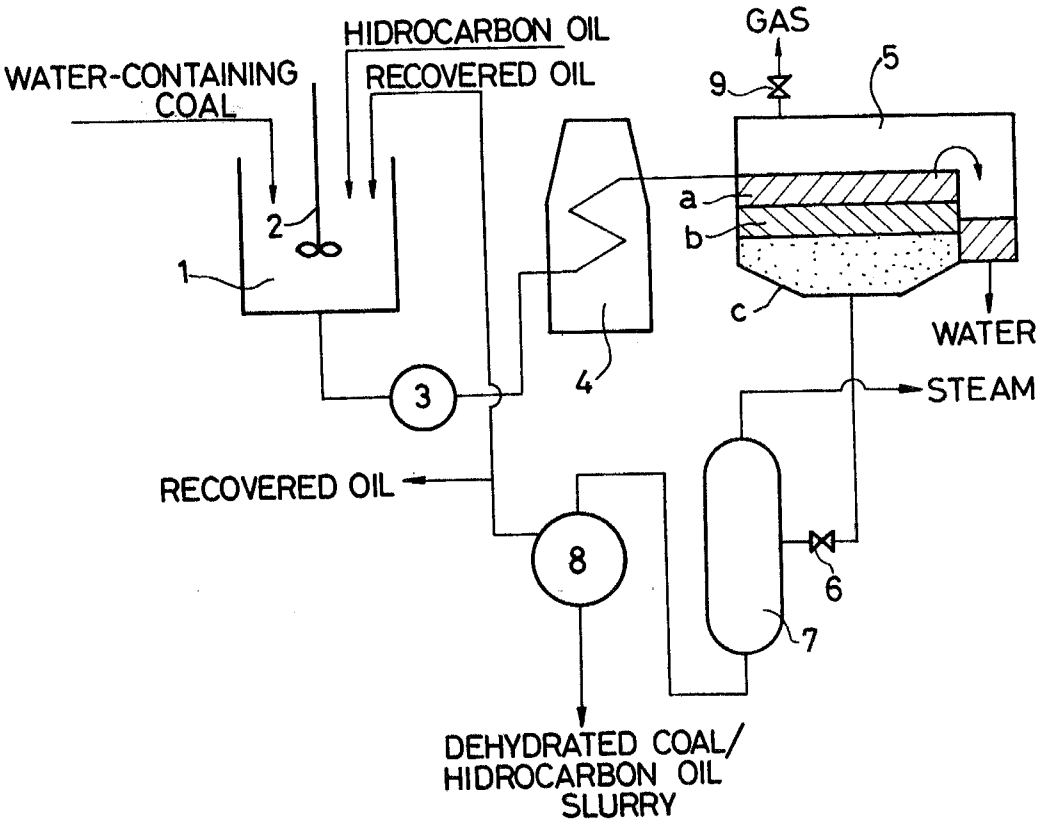
FIG. 4 is a flow sheet illustrating a further embodiment of the present invention.

FIG. 4 is a flow sheet illustrating a further embodiment of the present invention. This embodiment is the same as that illustrated in FIG. 3 except that the dehydrated slurry withdrawn from gravity separation tank 5 is subjected to another dehydration step. It is particularly useful in the treatment of various types of lignite, solid organic materials, and the like. As contrasted with the embodiment illustrated in FIG. 3, a reducing valve 6 and a flash evaporator 7 are provided between gravity separation tank 5 and concentrator 8. When the dehydrated slurry withdrawn from gravity separation tank 5 is fed through reducing valve 6 to flash evaporator 7, an additional amount of water is evaporated by utilization of the heat energy possessed by the slurry. After this second dehydration step, the slurry is introduced into concentrator 8, where the residual water and a part of the hydrocarbon oil are removed. The resulting slurry is then fed to a coal processing plant.

As described above, the present invention provides a novel process for the treatment of water-containing coal by which various types of coals ranging from anthracite to phytogenic solid organic materials composed largely of carbon can be treated to remove their inherent moisture as well as the water attached thereto. This process has many advantages. First, the material being treated remains in the form of a fluid throughout the process and are easy to handle. Secondly, since the vaporization of water is not allowed, the latent heat of vaporization is not required. Accordingly, a much higher thermal efficiency can be achieved than that of the conventional evaporation process using a hot air stream. Thirdly, in contrast to the Fleissner process and the process disclosed in Australian Pat. No. 32,607/68, water can be efficiently separated from coal having any particle size distribution. Accordingly, coal-deashing processes in which coal is finely ground to free it of ash satisfactorily can be employed, and aqueous slurries of coal crushed to 4-mm size or finer and conveyed through a pipeline can also be treated readily. Fourthly, that fraction of ash which dissolves in water at the temperature of the gravity separation zone and that fraction of ash which suspends in water due to its hydrophilic properties can be removed together with the water separated from the coal. Fifthly, the unnecessary incorporation of atmospheric oxygen (i.e. partial oxidation) which unavoidably occurs in the conventional evaporation process using a hot air stream can be prevented. Moreover, the danger of combustion or explosion in a drying oven is eliminated. Lastly, not only the partial oxidation of coal is prevented, but also the oxygen-containing groups which are present in coal and responsible for an increased hydrogen consumption during its liquefaction are decomposed at the heating temperature, the decomposition products being separated in the form of an aqueous solution or a gas. Thus, the consumption of hydrogen in the succeeding coal liquefaction process can be decreased.

The present invention will be more fully understood by reference to the following examples. However, these examples are intended merely to illustrate the practice of the invention and are not to be construed to limit the scope of the invention.

EXAMPLE 1

Strongly hydrophilic brown coal was ground to a sufficient degree. The ground brown coal, which had a water content of 60% was treated in accordance with the embodiment illustrated in FIG. 1. Specifically, a mixing tank 1 was charged with the ground brown coal and creosote oil having a specific gravity of 1.07 in a weight ratio of 1:2 to form a raw mixture having a water content of 20%. This raw mixture was pressurized to 60 kg/cm$^2$ G by means of a pump 3, heated in a heater 4 so that its temperature in a gravity separation tank 5 would be 275° C., and then introduced into gravity separation tank 5. The residence time in gravity separation tank 5 was 15 minutes. Under these conditions, the water withdrawn from the top of gravity separation tank 5 amounted to 15.5% of the raw mixture and its chemical oxygen demand (COD) was 15,000 ppm. This COD level permits a wet oxidation process to be suitably applied to the treatment of the water.

On the other hand, the dehydrated slurry consisting of the dehydrated brown coal and the creosote oil was withdrawn from the bottom of gravity separation tank 5. Its water-content was 5%. Since this slurry had a pressure of 60 kg/cm$^2$ G and a temperature of 275° C., it was capable of being directly fed to a plant for further processing the dehydrated coal/hydrocarbon oil slurry.

EXAMPLE 2

Strongly hydrophilic brown coal was ground to a sufficient degree. The ground brown coal, which had a water content of 60%, was treated in accordance with the embodiment illustrated in FIG. 2. Specifically, a mixing tank 1 was charged with the ground brown coal and a circulating solvent for use in the liquefaction of coal in a weight ratio of 1:1.5 to form a raw mixture having a water content of 24%. This raw mixture was pressurized to 30 kg/cm$^2$ G by means of a pump 3, heated in a heater 4 so that its temperature in a gravity separation tank 5 would be 232° C., and then introduced into gravity separation tank 5. Under these conditions, the water withdrawn from the top of gravity separation tank 5 amounted to 16% of the raw mixture, while the dehydrated slurry withdrawn from the bottom of gravity separation tank 5 had a water content of 9.5%. This slurry was fed through a reducing valve 6 to a flash evaporator 7, where an additional amount of water was removed by evaporation. The resulting dehydrated coal/hydrocarbon oil slurry had a water content of 2% and a temperature of 110° C.

EXAMPLE 3

Oleophilic coal having an inherent moisture content of 1% was deashed by flotation. The dressed coal, which had a water content of 25%, was treated in accordance with the embodiment illustrated in FIG. 1. Specifically, a mixing tank 1 was charged with 1 kg of the dressed coal and 1.5 kg of creosote oil having a specific gravity of 1.05 to form a raw mixture having a water content of 10%. This raw mixture was pressurized to 7 kg/cm$^2$ G by means of a pump 3, heated in a heater 4 so that its temperature in a gravity separation tank 5 would be 160° C., and then introduced into gravity separation tank 5. The residence time in gravity separation tank 5 was 30 minutes. The dehydrated slurry withdrawn from the bottom of gravity separation tank 5 had a water content of 2.2% and a coal concentration of 33%.

EXAMPLE 4

Oleophilic coal having an ash content of 34% on a dry basis was ground to 60-mesh size or finer. Then, 20 g of fuel oil C was added to 100 g of the ground coal, and the resulting mixture was pelletized by agitating it in water. The resulting pellets of about 2-mm diameter, which had a water content of 25% and an ash content of 18% on a dry basis, were treated in accordance with the embodiment illustrated in FIG. 2. Specifically, a mixing tank 1 was charged with 1 kg of the pellets and 1.5 kg of a circulating solvent for use in the liquefaction of coal to form a raw mixture having a water content of 10% and an coal concentration of 24%. This raw mixture was pressurized to 20 kg/cm$^2$ G by means of a pump 3, heated in a heater 4 so that its temperature in a gravity separation tank 5 would be 200° C., and then introduced into gravity separation tank 5. When a sample was taken and analyzed for water, the dehydrated slurry withdrawn from the bottom of gravity separation tank 5 had a water content of 4.5%. This slurry was fed through a reducing valve 6 to a flash evaporator 7, where an additional amount of water was removed by evaporation. The resulting dehydrated coal/hydrocarbon oil slurry had a water content of 0.5% and a temperature of 130° C. This slurry was capable of being directly fed to a coal liquefaction plant.

EXAMPLE 5

Strongly hydrophilic brown coal was ground to a sufficient degree. The ground brown coal, which had a water content of 60%, was treated in accordance with the embodiment illustrated in FIG. 3. Specifically, a mixing tank 1 was charged with the ground brown coal and creosote oil having a specific gravity of 1.07 in a weight ratio of 1:2 to form a raw mixture having a water content of 20%. This raw mixture was pressurized to 65 kg/cm$^2$ G by means of a pump 3, heated in a heater 4 so that its temperature in a gravity separation tank 5 would be 275° C., and then introduced into gravity separation tank 5. The residence time in gravity separation tank 5 was 15 minutes. Under these conditions, the water withdrawn from the top of gravity separation tank 5 amounted to 15.5% of the raw material and its chemical oxygen demand (COD) was 15,000 ppm. This COD level permits a wet oxidation process to be suitably applied to the treatment of the water.

On the other hand, the dehydrated slurry withdrawn from the bottom of gravity separation tank 5 consisted of 5% of water, 13.1% of dehydrated brown coal, and 81.9% of creosote oil. This slurry was introduced into a settling separator 8, where the residual water and a part of the creosote oil were removed to obtain a slurry having a coal concentration of 35%. The resulting dehydrated coal/hydrocarbon oil slurry was suitable for use in coal processing plants. The recovered creosote oil was recycled to mixing tank 1.

EXAMPLE 6

Strongly hydrophilic brown coal was ground to a sufficient degree. The ground brown coal, which had a water content of 60%, was treated in accordance with the embodiment illustrated in FIG. 4. Specifically, a mixing tank 1 was charged with the ground brown coal and a circulating solvent for use in the liquefaction of coal in a weight ratio of 1:1.5 to form a raw mixture having a water content of 24%. This raw mixture was pressurized to 30 kg/cm$^2$ G by means of a pump 3, heated in a heater 4 so that its temperature in a gravity separation tank 5 would be 232° C., and then introduced into gravity separation tank 5. Under these conditions, the water withdrawn from the top of gravity separation tank 5 amounted to 16% of the raw mixture, while the dehydrated slurry withdrawn from the bottom of gravity separation tank 5 had a water content of 9.5%. This slurry was fed through a reducing valve 6 to a flash evaporator 7, where an additional amount of water was removed by evaporation. The resulting slurry consisted of 2% of water, 20% of the dehydrated brown coal, and 78% of the circulating solvent. Thereafter, this slurry was introduced into a centrifugal separator 8, where the residual water and a part of the circulating solvent were removed to obtain a slurry having a coal concentration of 45%. The resulting dehydrated coal/hydrocarbon oil slurry was suitable for use in coal processing plants. The recovered circulating oil was recycled to mixing tank 1.

What is claimed is:

1. A process for the treatment of water-containing coal which comprises:

(a) in a mixing zone, mixing the water-containing coal with a hydrocarbon oil having a specific gravity higher than that of water at temperatures in the range of 100° to 350° C.;

(b) heating the resulting mixture to a temperature in the range of 100° to 350° C. and a pressure not lower than the saturated vapor pressure of water at that temperature; and (c) introducing the heated mixture into a gravity separation zone at a temperature in the range of 100° to 350° C. and a pressure not lower than the saturated vapor pressure of water at that temperature, whereby the water separated from the water-containing coal is withdrawn from an upper section of the gravity separation zone and the mixture consisting of the dehydrated coal and the hydrocarbon oil is withdrawn from a lower section of the gravity separation zone.

2. A process as claimed in claim 1 wherein the hydrocarbon oil is a hydrocarbon oil obtained from coal.

3. A process as claimed in claim 1 wherein the hydrocarbon oil is a hydrocarbon oil obtained from petroleum.

4. A process as claimed in claim 1 wherein the hydrocarbon oil is a circulating solvent for use in the liquefaction of coal.

5. A process as claimed in claim 1 wherein the temperature of the gravity separation zone is in the range of 100° to 300° C.

6. A process as claimed in claim 1 wherein the water-containing coal is an oleophilic coal having a rank of coalification equal to or higher than that of sub-bituminous coal, and the temperature of the gravity separation zone is in the range of 100° to 220° C.

7. A process as claimed in claim 1 wherein the water-containing coal is a coal having a rank of coalification equal to or lower than that of brown coal and the temperature of the gravity separation zone is in the range of 200° to 300° C.

8. A process as claimed in claim 1 wherein the water-containing coal is a solid organic material composed largely of carbon, and the temperature of the gravity separation zone is in the range of 200° to 300° C.

9. A process as claimed in claim 1 wherein the residual water present in the mixture consisting of the dehydrated coal and the hydrocarbon oil is evaporated by exposing the mixture to a pressure lower than that of the gravity separation zone.

10. A process as claimed in claim 1 wherein the concentration of the dehydrated coal in the mixture consisting of the dehydrated coal and the hydrocarbon oil is increased by removing the residual water and a part of the hydrocarbon oil from the mixture.

11. A process as claimed in claim 9 wherein the concentration of the dehydrated coal in the mixture freed of the residual water is increased by removing a part of the hydrocarbon oil from the mixture.

12. A process as claimed in claim 10 wherein the removed hydrocarbon oil is utilized as a part of the hydrocarbon oil used in the mixing zone.

13. A process as claimed in claim 11 wherein the removed hydrocarbon oil is utilized as a part of the hydrocarbon oil used in the mixing zone.

* * * * *